United States Patent [19]

Khanzadian et al.

[11] 4,383,779

[45] May 17, 1983

[54] CLEANSING DEVICE WITH DOOR FOR DRIP CATCHING

[76] Inventors: Sarkis Khanzadian, 642 E. Weldon, Fresno, 93704; Ketty C. Chamlian, 7452 N. Van Ness, Fresno, Calif. 93711

[21] Appl. No.: 264,666

[22] Filed: May 18, 1981

[51] Int. Cl.[3] ..... B05C 17/00; A46B 11/00

[52] U.S. Cl. ..... 401/15; 251/297; 251/321; 401/42; 401/203; 401/204; 401/289

[58] Field of Search ..... 401/40–43, 401/203, 204, 289, 15; 251/321, 297

[56] References Cited

U.S. PATENT DOCUMENTS

| | | | |
|---|---|---|---|
| 565,408 | 9/1896 | Foley . | |
| 956,105 | 4/1910 | Knickerbocker . | |
| 1,358,733 | 11/1920 | Heine . | |
| 2,026,981 | 1/1936 | Kahnt . | |
| 2,116,864 | 5/1938 | Fahrenbach . | |
| 2,238,588 | 4/1941 | Hagopian . | |
| 2,290,378 | 7/1942 | Motto . | |
| 2,647,273 | 8/1953 | Eagle . | |
| 2,658,218 | 11/1953 | Carreiro | 401/203 |
| 2,779,961 | 2/1957 | Laughlin | 401/203 X |
| 2,779,962 | 2/1957 | Cooper | 401/42 |
| 2,795,460 | 6/1957 | Bletcher et al. . | |
| 4,123,004 | 10/1978 | Jerry . | |

FOREIGN PATENT DOCUMENTS

| | | | |
|---|---|---|---|
| 319119 | 2/1902 | France | 401/42 |
| 506349 | 12/1954 | Italy | 401/43 |
| 833653 | 7/1957 | United Kingdom | 401/203 |
| WO80/00787 | 5/1980 | PCT Int'l Appl. | 401/289 |

*Primary Examiner*—Steven A. Bratlie
*Attorney, Agent, or Firm*—Huebner & Worrel

[57] ABSTRACT

A cleansing device for use in a substantially erect attitude, the device having a housing with a grasping portion and a cleansing portion and a passage extending through the housing interconnecting the grasping and cleansing portions; a conduit mounted on the grasping portion of the housing having a distal end portion adapted to be connected to a source of liquid for transfer of liquid from the source through the conduit and into the passage of the housing; and a liquid absorbent element affixed on the cleansing portion of the housing in communication with the passage and facing in an upward direction when the housing is held in a substantially erect attitude with the cleansing portion higher than the grasping portion.

6 Claims, 6 Drawing Figures

CLEANSING DEVICE WITH DOOR FOR DRIP CATCHING

BACKGROUND OF THE INVENTION

1. Field of the Invention

The present invention relates to a cleansing device and more particularly to such a cleansing device which controls the application of a cleansing liquid in such a manner that it can be employed with substantially improved effectiveness while simultaneously minimizing the risk of damage to surrounding areas.

2. Description of the Prior Art

Cleansing devices of a variety of types having long been known in which a cleansing liquid, such as water, is released in a spray or directed through a brush, sponge or the like. Where such devices are for use in bathing, use has been restricted to showers and bathtubs where the water discharged from the device cannot cause damage to surrounding areas. Insofar as the Applicant is aware, there has not heretofore been a cleansing device which could be employed in locations other than these without the risk of damage to floors, carpets and the like or to clothing as a result of such residual water. Furthermore, no device has previously been available which is suited to cleansing elevationally varied skin surfaces such as the face.

Therefore, there is need for a cleansing device which is operable with little or no concern for damage to surrounding areas in that it confines the application of the cleansing solution to the area of use and there is furthermore need for a cleansing device which is suited to cleansing elevationally varied areas of the skin.

SUMMARY OF THE INVENTION

Therefore it is an object of the present invention to provide an improved cleansing device which avoids the problems inherent in prior art devices.

Another object is to provide such a cleansing device which is particularly well suited to cleansing elevationally varied surfaces such as facial areas of the skin.

Another object is to provide such a cleansing device which, during use, controls the application of a cleansing liquid in such a manner as to apply the liquid most effectively and to minimize the risk of damage to surrounding areas.

Another object is to provide such a cleansing device which during use collects residual cleansing liquid and disposes of it at a convenient location.

Another object is to provide such a cleansing device which employs an absorbent element which can readily be replaced when worn.

Another object is to provide such a cleansing device which employs a valve operable to control the flow of the cleansing liquid from the source and simultaneously activates the cleansing device for recovering residual cleansing liquid.

Another object is to provide such a cleansing device having a valve which operates simply and effectively to perform its various functions without risk of leakage and permits the user to activate and use the device without concern for leakage.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
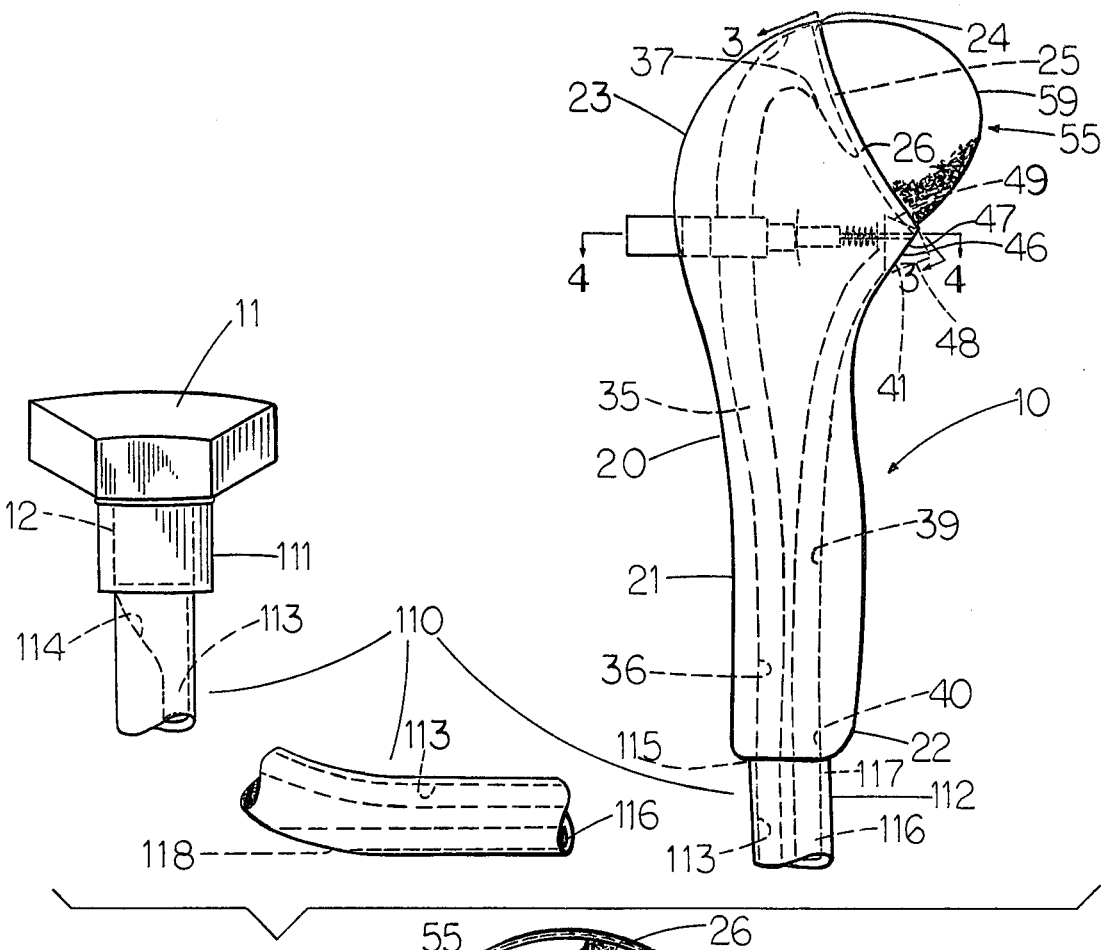
FIG. 1 is a fragmentary side elevation of the cleansing device of the present invention shown operatively connected to a faucet by its conduit shown fragmentarily for illustrative convenience.

Referring more particularly to the drawings, the cleansing device of the present invention is generally indicated by the numeral 10 in FIG. 1. As shown therein, the cleansing device is adapted operatively to be connected to a conventional faucet 11 having an externally screw threaded nozzle 12 through which water can selectively be discharged in the conventional manner using a control valve, not shown.

The cleansing device 10 has a housing 20 having a relatively narrow grasping portion 21 and a lower end portion 22. The housing has a cleansing portion 23 which is enlarged relative to the grasping portion and terminates in an upper end portion 24. The housing can be constructed of any suitable material, but is preferably constructed of durable plastic.

Figure 2:
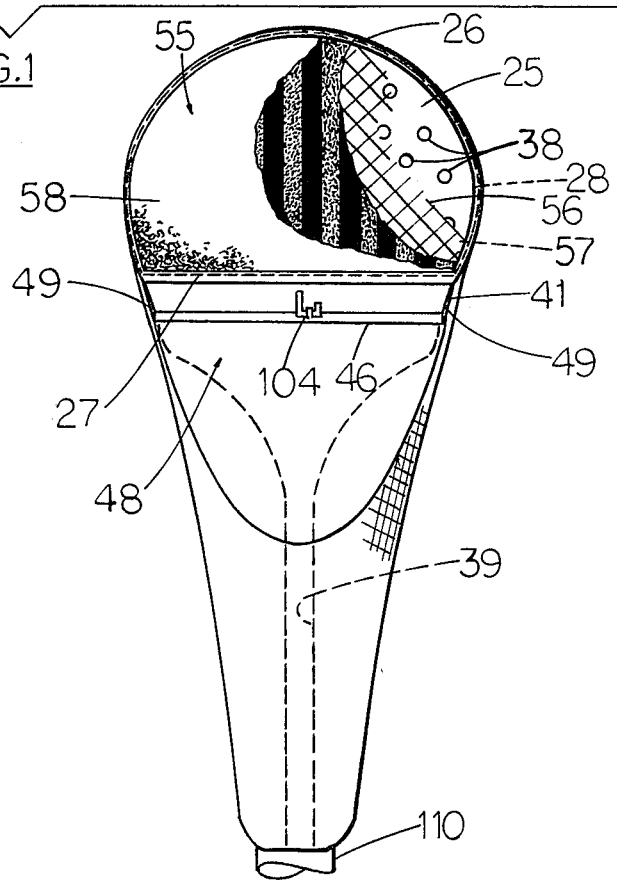
FIG. 2 is a fragmentary front elevation of the cleansing device shown with a door thereof disposed in an opened attitude.
Figure 3:
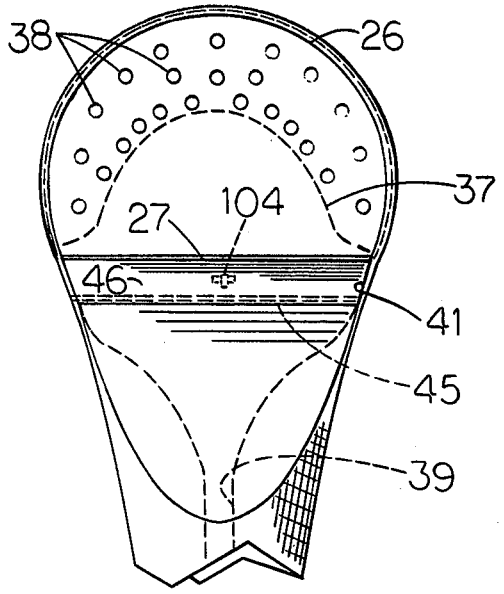
FIG. 3 is a fragmentary transverse section taken on line 3—3 in FIG. 1.

The upper end portion 24 of the housing 20 has a substantially flat, recessed surface 25 bounded by a curved peripheral ridge 26 and a lower peripheral ridge 27, both of which extend above the recessed surface. A groove 28 is formed in the ridges 26 and 27 above the recessed surface and extends about the periphery thereof, as best shown in FIGS. 2 and 3.

A first or main passage 35 extends through the housing 20 from a lower end portion 36 to an enlarged upper chamber 37 in the upper end portion 24 of the housing. A plurality of holes 38 extend from the upper chamber 37 through the recessed surface 25, as best shown in FIG. 3. A secondary or return passage 39 extends through the housing from a lower end portion 40 in the lower end portion 22 of the housing to an enlarged upper opening 41 extending through the housing to communicate with the exterior thereof immediately below the lower peripheral edge 27.

A shaft 45 is mounted on the housing extending across and within the enlarged upper opening 41 spaced from the ridge 27. A door or trough 46 is mounted on the shaft for pivotal movement between a closed attitude 47 shown in FIGS. 1 and 3 and an opened attitude 48 shown in FIG. 2. The door has upstanding sides 49 and is mounted in such a way that it collects water draining from thereabove and directs it into the return passage 39 when the door is in the opened attitude 48.

An absorbent cleansing element 55 is mounted on the upper end portion 24 in covering relation to the recessed surface 25. The cleansing element has a screen 56 with a periphery 57 dimensioned to be snap fitted into the groove 28 of the ridges 26 and 27. A sponge 58 is affixed on the screen by any suitable means and has a protruding outer surface 59 extending well beyond the ridges 26 and 27 of the housing 20, as shown in FIG. 1. By virtue of the snap fitting of the screen in the groove 28, the absorbent cleansing element can be removed for purposes of cleaning the recessed surface 25 as well as for replacement of the cleansing element when the sponge 58 becomes worn.

Figure 4:
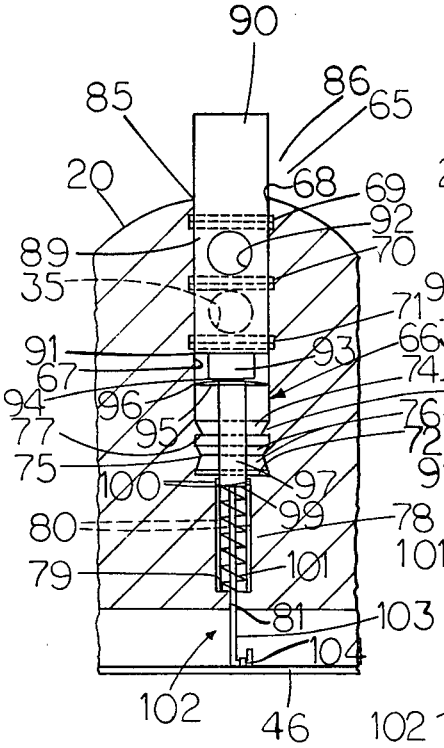
FIG. 4 is a somewhat enlarged, fragmentary transverse section taken on line 4—4 in FIG. 1 and showing the valve member of the valve assembly of the cleansing device in a first position.
Figure 5:
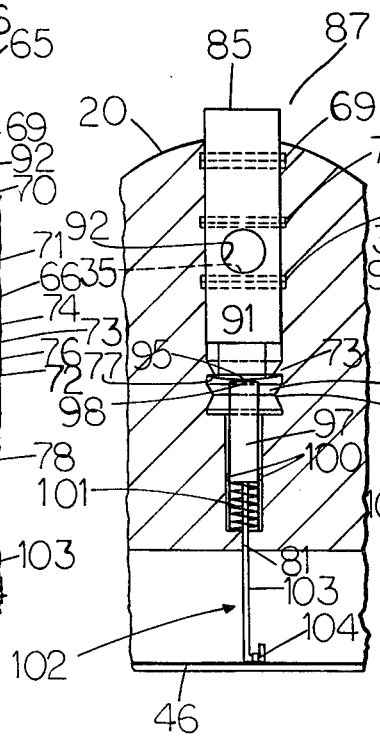
FIG. 5 is a fragmentary transverse section showing the valve member of the valve assembly of FIG. 4 in a second position.
Figure 6:
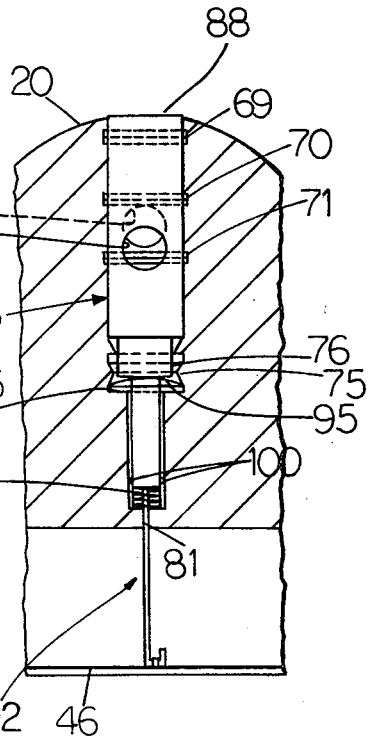
FIG. 6 is a fragmentary transverse section showing the valve member of the valve assembly of FIG. 4 in a third position.

The housing 20 has a valve assembly 65 best shown in FIGS. 4 through 6. The valve assembly includes a transverse passage 66 extending through the housing so as to intersect the main passage 35 thereof, as best shown in FIG. 1. The transverse passage has a first section 67 having an outer opening 68 communicating with the exterior of the housing on the side thereof opposite the opening 41. First, second and third sets of O-rings 69, 70 and 71 respectively are mounted on the housing within the first section of the passage in spaced relation to each other as shown in FIGS. 4 through 6. The first section extends to a shoulder 72 remote from the outer opening 68. A first annular ridge 73 is borne by the housing in the first section 67 of the transverse passage in predetermined spaced relation to the shoulder 72. The first annular ridge has a sloping surface 74 facing in the direction of the outer opening 68 of the passage 66. A second annular ridge 75 is borne by the housing in a predetermined position in the first section of the transverse passage between the first annular ridge and the shoulder 72, as best shown in FIGS. 4 through 6. The second annular ridge 75 has a pair of sloping surfaces 76 facing in opposite directions. The first and second annular ridges 73 and 75 define an annular space 77 in the transverse passage therebetween.

The transverse passage 66 has a second section 78 of smaller diameter than the first section and extending from the shoulder 72 of the first section to a shoulder 79. Slots 80 are formed in the housing 20 in predetermined positions extending longitudinally of the second section on opposite sides thereof from the shoulder 72 to the shoulder 79. A bore 81 is formed in the shoulder 79 extending through the housing and into communication with the opening 41 of the secondary passage 39 of the housing.

The valve assembly 65 has a valve member 85 which is slidably received in the transverse passage 66. The valve member is movable in the passage from a first position 86 shown in FIG. 4, to a second position 87 shown in FIG. 5, and to a third position 88 shown in FIG. 6. The valve member has a first portion 89 having an exterior end portion or plunger 90 and an opposite interior end portion 91. When the valve member is in the first position, the plunger is fully extended through the outer opening 68. A transverse bore 92 extends through the first portion of the valve member in position to be disposed between the first and second sets of O-rings 69 and 70, respectively, in the first position 86 and between the second and third sets of O-rings 70 and 71, respectively, in the second position 87. Similarly, the bore 92 is positioned so that it fully communicates with the main passage of the housing when the valve member is in the second position, but is completely sealed from the main passage by the O-rings 70 when the valve member is in the first position.

The valve member 85 has a second portion 93 of smaller diameter than the first portion 89 and disposed in axial alignment therewith extending to a beveled end portion 94. As can best be visualized in FIGS. 4 through 6, the diameter of the second portion is smaller than the openings defined by the first and second ridges 73 and 75 respectively.

A concavo-convex spring element or disk 95 is mounted on the beveled end portion 94 of the second portion 93 of the valve member 85 in axial alignment therewith. The disk has a periphery 96 which is very slightly smaller in diameter than the first section 67 of the passage 66. The disk is resilient to the degree that it can be inverted by the exertion of force about its periphery along a path parallel to the longitudinal axis of the valve member so as to cause it, in effect, to turn inside out. Thus, for example, when the valve member is in the first position shown in FIG. 4, the surface of the disk facing the outer opening 68 is convex. However, as will subsequently be described, when the valve member is moved to the second position shown in FIG. 5, the first ridge 73 causes the disk to be inverted so that the same surface flexes to form a concave configuration.

The valve member 85 has a third portion 97 mounted on the second portion to capture the disk 95 therebetween. The third portion has a beveled end portion 98 facing the disk 95. It will be understood that the beveled end portions 94 and 98 face each other with the disk captured therebetween and are sufficiently beveled or rounded to permit the flexing of the disk previously described. The third portion 97 has an end portion 99 opposite the beveled end portion 98. Pins 100 are mounted on and extend laterally from the opposite end portion 99 of the third portion 97 so as individually to be received in the slots 80 for slidable movement therewithin. The pins and slots are positioned so that the valve member moves through the first, second and third positions 86, 87 and 88 respectively nonrotationally and so that the transverse bore 92 is disposed in axial alignment with the main passage 35 when the valve member is in the second position 87, as shown in FIG. 5. A compression spring 101 is captured between the shoulder 79 and the pins 100 and extending about the opposite end portion 99. The compression spring resiliently urges the valve member toward the first position 86 shown in FIG. 4. A suitable linkage 102 interconnects the opposite end portion 99 of the third portion 97 of the valve member 85 and the door 46. As shown in the drawings, the linkage includes a rod 103 mounted on the opposite end portion 99 and extending through the compression spring 101, the bore 81 and pivotally mounted at its remote end on the door by a pivotal connection 104.

The cleansing device 10 has a conduit 110 which is shown fragmentarily in FIG. 1 and can be of any suitable length. The conduit has an internally screw threaded coupling 111 adapted to be screw-threadably secured on the nozzle 12 of the faucet 11, as shown in FIG. 1. The conduit has an opposite end portion 112 mounted on the lower end portion 22 of the housing 20. A main passage 113 extends longitudinally of and through the conduit from an enlarged chamber 114 in receiving relation to water from the faucet to an opposite end portion 115 communicating in fluid transferring relation to the lower end portion 36 of the main passage 35 of the housing. A discharge passage 116 extends through and longitudinally of the conduit from a receiving end portion 117 secured in fluid transferring relation to the lower end portion 40 of the return passage 39 of the housing to a discharge port or opening 118 extending outwardly through the outer surface of the conduit at a position spaced from the housing a sufficient distance conveniently to be positioned for discharge of residual water from the device. For example, when the cleansing device is in use attached to the faucet 11, the portion of the conduit having the discharge opening 118 can be rested in a sink below the faucet for discharge of residual water down the drain.

OPERATION

The operation of the described embodiment of the subject invention is believed to be clearly apparent and is briefly summarized at this point. When installed as described and as shown fragmentarily in FIG. 1, the cleansing device 10 is available for use at any time. In this arrangement the valve member 85 is in the first position 86 as shown in FIG. 4. Ordinarily at this time, the faucet 11 would be shut off. However, if it is left on the valve assembly 65 operates to prevent water from flowing therebeyond or leaking from the housing 20.

When the cleansing device 10 is to be used, the operator grasps the grasping portion 21 of the housing 20 to hold it in an erect attitude such as shown in FIG. 1. Subsequently, the plunger 90 of the valve member 85 is depressed to the position shown in FIG. 5 to move the valve member from the first position 86 to the second position 87. Movement of the valve member to the second position causes the transverse bore 92 to be positioned in axial alignment with the main passage 35 of the housing thereby permitting water to flow therethrough. At the same time, the linkage 102 opens the door 46 to the opened attitude 48 shown in FIG. 2.

Thereafter, the faucet 11 is turned on, using the control valve, not shown, to permit water to flow from the faucet. Water flows along the main passage 113 of the conduit 110, the main passage 35 of the housing 20, through the transverse bore 92 of the valve member 85 and into the upper chamber 37. The water is forced through the holes 38 in the recessed surface 25 of the housing and is absorbed by the absorbent element 55, or, more specifically, the sponge 58. The recessed surface bounded by the ridges 26 and 27 within which the sponge sits forms a pool for absorption of the water by the sponge. As the sponge rapidly becomes saturated with water, the operator uses the protruding outer surface 59 of the sponge to cleanse the face or any other area desired. The texture of the sponge and its saturated condition are excellently suited to cleaning of the skin. In addition, the shape of the outer surface 59 of the sponge as shown in FIG. 1 allows cleansing of uneven or elevationally varied surfaces.

The small diameter of the main passage 35 is such as to cause water flow to the sponge 58 to be maintained at a level consistent with the absorption rate of the sponge during use. Thus, there is little residual water or run off from the sponge. However, such water as is squeezed or otherwise flows from the sponge flows by gravity into the door 46 and is thus gravitationally delivered into the return passage 39 of the housing. Such residual water is transferred along the passage 39 and the discharge passage 116 of the conduit by gravity. It thus flows by gravity from the discharge opening 118 at a position, such as in a sink, where it can do no damage to surrounding areas.

When use of the cleansing device 10 is completed, the operator presses the plunger 90 further inwardly of the outer opening 68 to the position shown in FIG. 6. This causes the compression spring 101 to be compressed still further until, when the plunger is released, the compression spring forces the valve member therefrom and again into the first position 86 shown in FIG. 4. This causes the transverse bore 92 of the valve member 85 to be removed from registry with the main passage 35 and thus again to seal the main passage at the valve assembly. The engagement with the first portion 89 of the valve member by the first, second and third sets of O-rings 69, 70 and 71 respectively prevents leakage of water from the valve assembly. Simultaneously, the linkage 102 draws the door 46 to the closed attitude 47 shown in full lines in FIG. 1.

Referring more specifically to the operation of the valve assembly 65, the valve member is shown in FIG. 4 in the first position 86 with the disk 95 oriented so that its surface facing the first and second ridges 73 and 75 is concave. At this time, the compression spring 101 retains the entire valve member in the first position so that the plunger 90 is fully extended as shown in FIG. 4.

When the operator depresses the plunger 90 to the position shown in FIG. 5, the periphery 96 of the disk 95 is forced into engagement with the sloping surface 74 of the first ridge 73 which causes the disk to be inverted so that the surface facing the compression spring 101 is flexed into a convex configuration. As the periphery of the disk snaps beyond the sloping surface 74 of the first ridge 73, it is captured in the annular space 77 between the ridges 73 and 75. The resistance of the disk in the configuration shown in FIG. 5 is sufficient to hold the valve member against the force of the compression spring and in the second position 87 during use of the cleansing device. As previously discussed, movement of the valve member to the second position also moves the door 46 to the opened attitude 48.

When use of the cleansing device 10 has been completed, the operator depresses the plunger 90 further to the position shown in FIG. 6 and then releases the plunger. This action causes the periphery 96 of the disk 95 to slide up the nearest sloping surface 76 of the second ridge 75. At the time the periphery 96 of the disk snaps beyond the ridge and into engagement with the farthest sloping surface 76, the force exerted by the compression spring 101 has built to the point that it forces the valve member in the opposite direction as the plunger is released by the operator. Movement of the periphery 96 of the disk 95 on the farthest sloping surface 76 causes it again to invert to the position shown in FIG. 6 wherein the surface of the disk facing the compression spring is again in a concave configuration. The resistance offered by the convex surface of the disk in engagement with the ridges 73 and 75 is not sufficient to overcome the force of the compression spring 101 and thus the valve member and the disk pass through the ridges 73 and 75 and return the valve member to the first position 86 shown in FIG. 4. A cleansing device 10 is thus again available for use.

Therefore, the cleansing device of the present invention is excellently suited to the cleansing of the skin areas such as the face with risk of damage to surrounding areas from the spilling of residual water reduced to an absolute minimum in a device which is both inexpensive to purchase, convenient to use and fully dependable in performing its various functions.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. A cleansing device for use in a substantially erect attitude, the device comprising a housing having a grapsing portion and a cleansing portion, a first passage extending through the housing interconnecting the grasping and cleansing portions and a second passage extending from a position adjacent to the cleansing portion of the housing through the grasping portion to communicate with the exterior thereof; a conduit mounted on the grasping portion of the housing having a distal end portion adapted to be connected to a source of liquid for transfer of liquid from the source through the conduit and into the first passage of the housing; a liquid applying element borne by the cleansing portion of the housing in communication with the first passage; a door mounted on the housing adjacent to the liquid applying element and in communication with said second passage, the door being movable between a closed attitude and an opened attitude in receiving relation to residual liquid from the liquid applying element; and a valve assembly mounted in the housing and connected to the door selectively operable to open said first passage and move the door to said opened attitude to permit liquid to flow from the source of liquid through the first passage into the liquid applying element and said residual liquid therefrom to flow into the second passage through the door for discharge from the housing.

2. The cleansing device of claim 1 wherein the conduit has a discharge passage communicating at one end thereof in liquid receiving relation with the second passage of the housing and extending through the conduit to a discharge port remote from the housing for the discharge from the conduit of liquid received from the second passage.

3. A cleansing device adapted for use in a substantially erect attitude, comprising:

a. an elongated housing providing a lower end portion and an opposite, upper end portion enlarged relative thereto, the upper end portion having a continuous peripheral ridge circumscribing a substantially flat recessed surface having a plurality of apertures communicating therethrough, the housing having a first passage extending therewithin from the lower end portion to an enlarged upper chamber communicating with a portion of the recessed surface whereby liquid can move under pressure upwardly through the housing and exude from the housing through the apertures of the recessed surface, and having a second passage communicating with the exterior of the housing beneath the peripheral ridge and extending through the housing to the lower end portion thereof, whereby liquid exuded from the first passage can flow by gravity into the second passage and downwardly through the housing;

b. a conduit having an end portion mounted on the lower end portion of the housing and an end portion adapted for connection to a source of liquid, said conduit having a main passage extending therethrough communicating with the main passage of the housing and a discharge passage extending therethrough communicating with the second passage of the housing and extending to a discharge port remote from the housing for release of liquid from the device;

c. a liquid-absorbent cleansing element having a mounting screen with a peripheral dimension permitting the screen to be received in covering relation to the recessed surface in tensive engagement with said peripheral ridge of the housing to permit absorption by said element of liquid exuded from the first passage;

d. a door mounted in covering relation to the second passage beneath the cleansing element for pivotal movement between an opened attitude and a closed attitude, said door operating to guide liquid flowing gravitationally from the cleansing element into the second passage in said opened attitude; and e. a valve assembly including a valve member mounted for slidable movement in the housing transversely of the first passage and having a bore extending transversely through the valve member, the valve member slidable between a first position in which the valve member occludes the first passage and a second position wherein said bore communicates with the first passage, the valve assembly further including a linkage interconnecting the valve member and the door for movement of the door in response to movement of the valve member, whereby the door is retained in said closed attitude when the valve member is in said first position and the door is maintained in said opened attitude when the valve member is in said second position.

4. The cleansing device of claim 3 wherein the valve member mounts a flexibly invertable concavo-convex disk and the housing has a ridge therein engageable by said disk in the second position of the valve member releasably to retain the valve assembly in the second position.

5. The cleansing device of claim 4 including a compression spring captured between the housing and the valve member forcibly to return the valve member to the first position upon initial movement of the valve member beyond said second position.

6. The cleansing device of claim 3 wherein the transverse dimension of said first passage is sufficiently small to limit the amount of liquid available for absorption by said element substantially to that capable of being absorbed by the cleansing element during cleansing.

* * * * *